US007741550B2

(12) United States Patent
Miyajima

(10) Patent No.: US 7,741,550 B2
(45) Date of Patent: Jun. 22, 2010

(54) STRAINER SYSTEM OF SNARE DRUM AND SNARE DRUM WITH THE STRAINER SYSTEM

(75) Inventor: Hideyuki Miyajima, Seto (JP)

(73) Assignee: Hoshino Gakki Co., Ltd. (JP)

( * ) Notice: Subject to any disclaimer, the term of this patent is extended or adjusted under 35 U.S.C. 154(b) by 1 day.

(21) Appl. No.: 12/038,492

(22) Filed: Feb. 27, 2008

(65) Prior Publication Data

US 2009/0133564 A1 May 28, 2009

(30) Foreign Application Priority Data

Nov. 28, 2007 (JP) ..... P2007-307532

(51) Int. Cl.
*G10D 13/02* (2006.01)

(52) U.S. Cl. ..... 84/415

(58) Field of Classification Search ..... 84/415
See application file for complete search history.

(56) References Cited

U.S. PATENT DOCUMENTS

| | | | | | |
|---|---|---|---|---|---|
| 1,236,667 | A * | 8/1917 | Bower | 84/415 |
| 1,279,627 | A * | 9/1918 | Winne | 84/415 |
| 1,442,833 | A * | 1/1923 | Soderberg | 84/415 |
| 1,722,032 | A * | 7/1929 | Bower | 84/415 |
| 3,113,481 | A * | 12/1963 | Thompson | 84/415 |
| 3,981,220 | A * | 9/1976 | Clark | 84/415 |
| 4,018,130 | A * | 4/1977 | Gariepy, Sr. | 84/415 |
| 4,138,920 | A * | 2/1979 | Meador | 84/415 |
| 5,107,742 | A | 4/1992 | Cummings et al. | |
| 5,684,257 | A * | 11/1997 | Yanagisawa | 84/415 |
| 6,091,010 | A * | 7/2000 | Gauger | 84/415 |
| 6,441,287 | B1 * | 8/2002 | Crouch et al. | 84/415 |
| 6,689,944 | B1 * | 2/2004 | Okumura | 84/411 R |
| 6,891,098 | B1 * | 5/2005 | Lombardi | 84/415 |
| 7,151,211 | B2 * | 12/2006 | Whittington et al. | 84/415 |
| 7,223,910 | B2 * | 5/2007 | Shimada | 84/415 |
| 2009/0133564 | A1 * | 5/2009 | Miyajima | 84/415 |

FOREIGN PATENT DOCUMENTS

| | | |
|---|---|---|
| JP | 43-22073 | 9/1968 |
| JP | 47-019020 | 11/1972 |
| JP | 56-115186 | 9/1981 |
| JP | 60-163499 | 10/1985 |
| JP | 60-163500 | 10/1985 |
| JP | 3902213 | 12/2005 |

OTHER PUBLICATIONS

Japanese Office Action mailed Nov. 4, 2009 in corresponding Japanese Patent Application No. 2007-307532 and an English-language translation of the same.

* cited by examiner

*Primary Examiner*—Jeffrey Donels
*Assistant Examiner*—Robert W Horn
(74) *Attorney, Agent, or Firm*—Ostolenk Faber LLP

(57) ABSTRACT

A snare drum includes a strainer system which switches the position of a snare wire between an OFF position spaced from a lower drumhead and an ON position in contact with the lower drumhead. The strainer system includes a frame to which the snare wire is attached, and a pair of link mechanisms which are joined to the respective end portions of the frame and attach the respective end portions of the frame to a shell of the snare drum. After switching the position of the snare wire to the ON position, the position of the snare wire with respect to the lower drumhead is adjusted by operating an adjust screw of the second link mechanism.

13 Claims, 8 Drawing Sheets

STRAINER SYSTEM OF SNARE DRUM AND SNARE DRUM WITH THE STRAINER SYSTEM

BACKGROUND OF THE INVENTION

The present invention relates to a strainer system of a snare drum and a snare drum with the strainer system.

A snare drum includes a cylindrical shell, a pair of drumheads fitted to the upper and lower open ends of the shell, and a snare wire tensioned along the surface of the lower drumhead. The snare wire vibrates when the drumhead is beaten in contact with the snare wire. As a structure for holding this snare wire with respect to the shell, a structure using a belt or a string is known. As defects of this holding structure, the tension of the snare wire and the contact pressure of the snare wire with respect to the drumhead cannot be adjusted separately, and the tension of the snare wire makes it difficult to operate the strainer. If the snare wire is spaced from the drumhead, the tension of the snare wire cannot be maintained, and noise easily occurs from the snare wire. To eliminate these defects, for example, Japanese Utility Model Publication No. 43-22073 and U.S. Pat. No. 3,981,220 each disclose a method in which a snare wire is attached to a frame and the frame is fitted to a shell. However, according to the methods disclosed in Japanese Utility Model Publication No. 43-22073 and U.S. Pat. No. 3,981,220, the frame is held with respect to the shell by using a belt or a string, so that although the snare wire can be brought into uniform contact with the drumhead, operations for, for example, removing and fitting the frame from and to the shell for replacement of the drumhead are troublesome. To solve this problem, for example, Japanese Laid-Open Utility Model Publication No. 60-163499, Japanese Laid-Open Utility Model Publication No. 60-163500, and Japanese Patent No. 3902213 disclose strainer systems which include a frame holding mechanism for holding the frame with respect to the shell.

When playing the snare drum, to improve the sound response and tone of the snare wire, it is preferable that the snare wire is brought into uniform contact with the surface of the drumhead. However, in some cases of the strainer systems disclosed in Japanese Laid-Open Utility Model Publication No. 60-163499, Japanese Laid-Open Utility Model Publication No. 60-163500, and Japanese Patent No. 3902213, the snare wire cannot be made parallel to the surface of the drumhead, and the snare wire cannot be brought into uniform contact with the surface of the drumhead. Therefore, adjusting mechanisms which adjust the positions of a first end portion and a second end portion of the frame with respect to the drumhead are provided corresponding to the respective ends of the frame. According to this type of strainer system, to adjust the contact pressure of the snare wire with respect to the drumhead, it is necessary to adjust the position of the frame by operating the adjusting mechanisms at the two positions. However, this operation is troublesome for a player, and it is difficult to adjust the position of the frame.

SUMMARY OF THE INVENTION

An objective of the present invention is to provide a strainer system of a snare drum which is improved in operability of changing the position of the snare wire with respect to the drumhead, and a snare drum with this strainer system.

To achieve the foregoing objective and in accordance with one aspect of the present invention, a strainer system of a snare drum which switches the position of a snare wire between an OFF position spaced from the surface of a drumhead and an ON position in contact with the surface of the drumhead. The strainer system includes a frame, a pair of link mechanisms, and an operating section. The snare wire is attached to the frame. The frame extends along the surface of the drumhead and has a pair of end portions. The link mechanisms are joined to the respective end portions of the frame, and attach the end portions of the frame to a shell of the snare drum. The operating section is operated for switching the position of the snare wire between the OFF position and the ON position. The operating section is provided in either one of the pair of link mechanisms.

In accordance with another aspect of the present invention, a snare drum having a cylindrical shell, a pair of drumheads which close upper and lower open ends of the shell, and a strainer system is provided. The strainer system switches the position of a snare wire between an OFF position spaced from the surface of the drumhead and an ON position in contact with the surface of the drumhead. The strainer system includes a frame, a pair of link mechanism, and an operating section. The snare wire is attached to the frame. The frame extends along the surface of the drumhead and has a pair of end portions. The link mechanisms are joined to the respective end portions of the frame, and attach the end portions of the frame to the shell of the snare drum. The operating section is operated for switching the position of the snare wire between the OFF position and the ON position. The operating section is provided in either one of the pair of link mechanisms.

DETAILED DESCRIPTION OF THE PREFERRED EMBODIMENTS

Hereinafter, one embodiment of a strainer system of a snare drum of the present invention will be described with reference to FIGS. 1 to 7.

Figure 1:
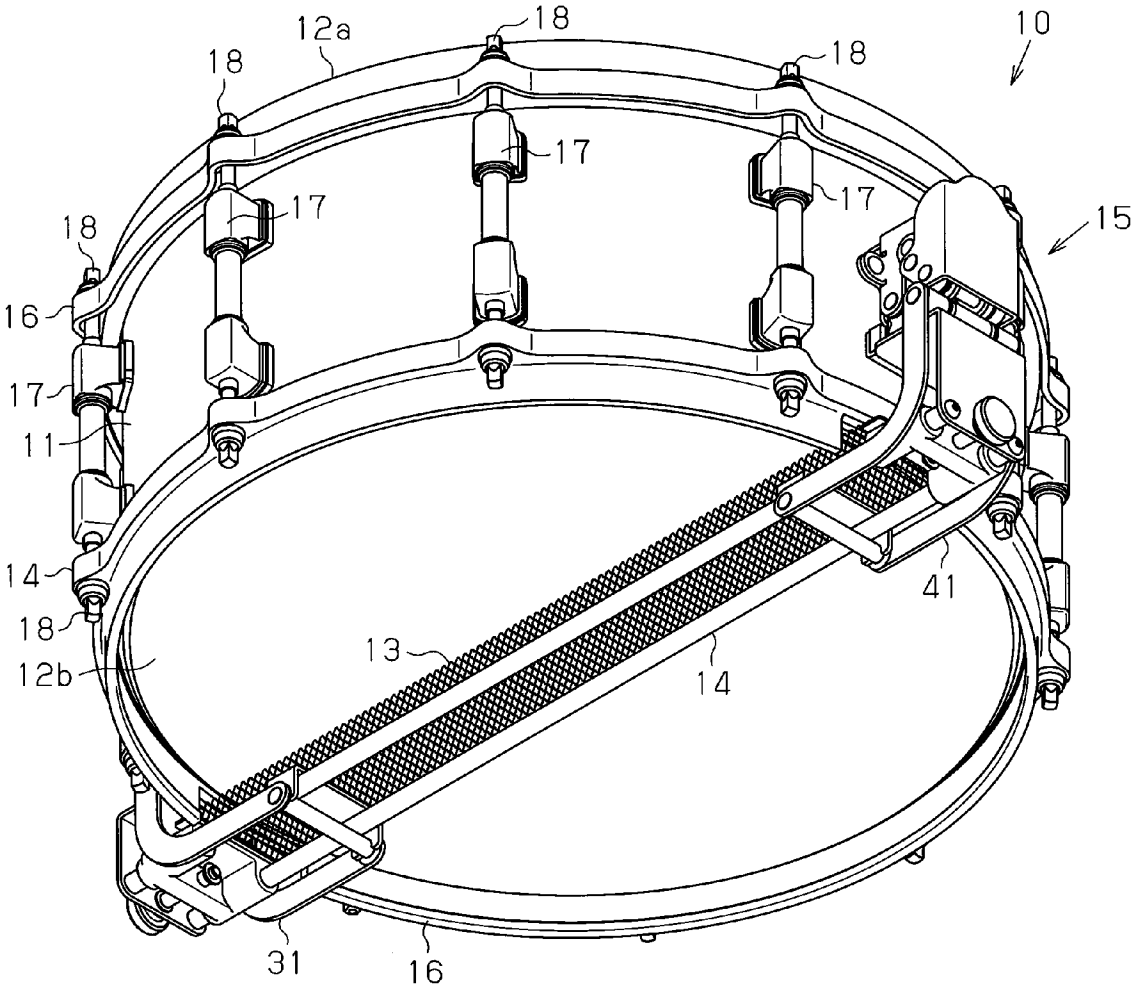
FIG. 1 is a perspective view from the back side, illustrating a snare drum with a strainer system according to one embodiment.

As shown in FIG. 1, the snare drum 10 includes a cylindrical shell 11, an upper drumhead 12*a* closing an upper open end of the shell 11, a lower drumhead 12*b* closing a lower open end of the shell 11, a snare wire 13 tensioned along the surface of the lower drumhead 12*b*, and a strainer system 15 which switches the position of the snare wire 13 between an OFF position spaced from the lower drumhead 12*b* and an ON position in contact with the lower drumhead 12*b*. When the upper drumhead 12*a* is beaten in a state that the position of the snare wire 13 is switched to the ON position, the snare wire 13 vibrates with the upper drumhead 12*a* and the lower drumhead 12*b*, and vibration sounds unique to the snare drum 10 are produced.

At both open ends of the shell 11, annular hoops 16 are provided, respectively. The respective drumheads 12*a* and 12*b* are supported on the open ends of the shell 11 with the hoops 16. On the outer peripheral surface of the shell 11, a plurality of lugs 17 and a plurality of lug bolts 18 for fixing the hoops 16 are provided. By tightening and loosening the lug bolts 18 inserted in the holes of the lugs 17, the tensions of the drumheads 12*a* and 12*b* are changed and the tone of the snare drum 10 is adjusted.

Figure 2:
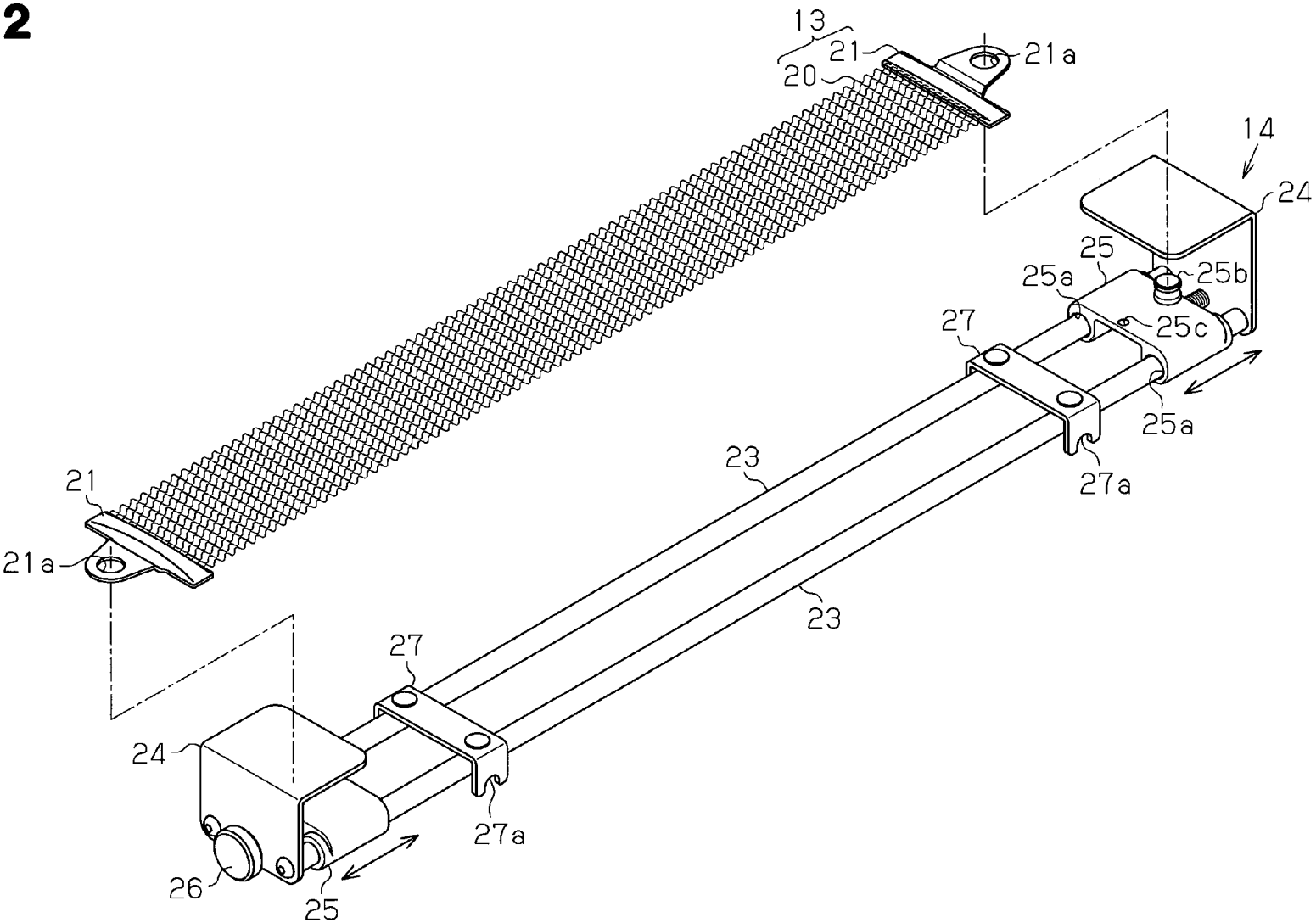
FIG. 2 is a perspective view showing a snare wire and a frame.

As shown in FIGS. 1 and 2, the snare wire 13 includes a plurality of metal strands 20 and a pair of attachment tools 21 which joins both ends of the strands 20. In each attachment tool 21 of the snare wire 13, a circular hole 21*a* is made. The strainer system 15 includes a frame 14 to which the snare wire 13 constituted as described above is attached. The frame 14 extends along the surface of the lower drumhead 12*b* and has a pair of end portions. The frame 14 includes a pair of rods 23 arranged in parallel, a pair of brackets 24 fixed to the ends of the rods 23, a pair of moving members 25 fitted slidably to the rods 23, a pair of adjust screws 26 for adjusting the positions of the moving members 25 with respect to the rods 23, and a pair of hooks 27 fixed to the rods 23. In the present embodiment, the pair of rods 23, the pair of moving members 25, and adjust screws 26 constitute a tension changing means capable of changing the tension of the snare wire 13 attached to the frame 14 and a position changing means capable of changing the position in the lateral direction of the snare wire 13 with respect to the lower drumhead 12*b*.

Each bracket 24 is an inverted-L shaped cross section, and arranged so as to face the other bracket 24. In each moving member 25, a pair of holes 25*a* through which the rods 23 are inserted are made. On the upper surface of each moving member 25, a protrusion 25*b* which is engaged in the hole 21*a* of each attachment tool 21 of the snare wire 13, and a support protrusion 25*c* which supports each attachment tool 21 of the snare wire 13 from below are provided. In the end face of each moving member 25, a screw hole (not shown) in which the adjust screw 26 inserted through the bracket 24 from the outer surface is screwed is made (not shown). By turning the adjust screw 26 and thereby changing the position of the adjust screw 26 in the screw hole of the moving member 25, the moving member 25 is moved along the axis lines of the rods 23. Each hook 27 has a U sectional shape, and is provided at a position closer to the center of each rod 23 than the end of each rod 23. In both side walls of each hook 27, semicircular engagement holes 27*a* opened downward are made.

The strainer system 15 has a pair of link mechanisms 31 and 41 which join both ends of the frame 14 constituted as described above to the shell 11. The first link mechanism 31 attaches a first end portion (left end shown in FIG. 1) of the frame 14 to the shell 11. The second link mechanism 41 attaches a second end portion (right end shown in FIG. 1) of the frame 14 to the shell 11. The first and second link mechanisms 31 and 41 are provided at positions symmetrical to each other about the center of the lower drumhead 12*b* on the outer peripheral surface of the shell 11.

Figure 3:
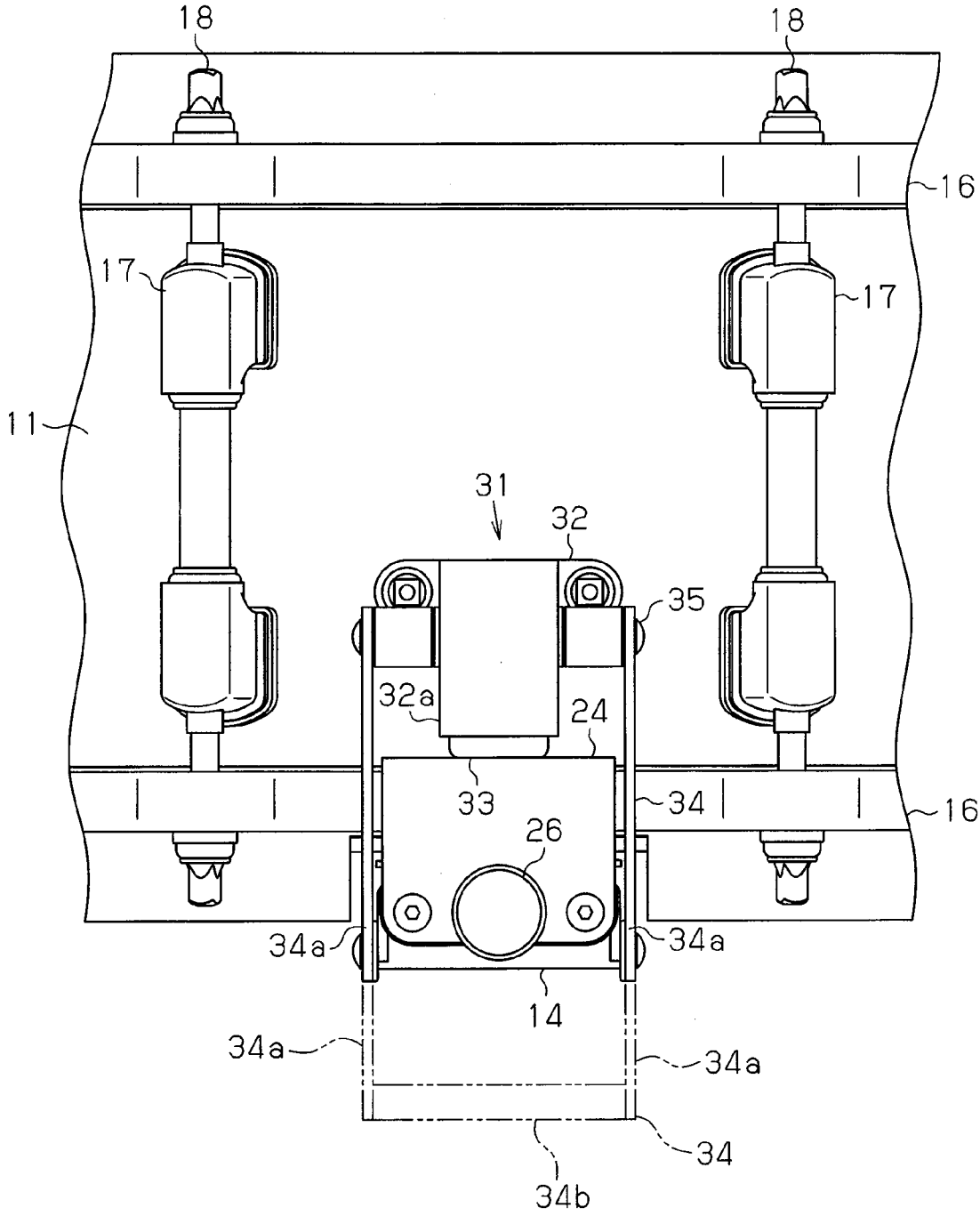
FIG. 3 is an enlarged partial front view showing a first link mechanism of the strainer system.
Figure 4:
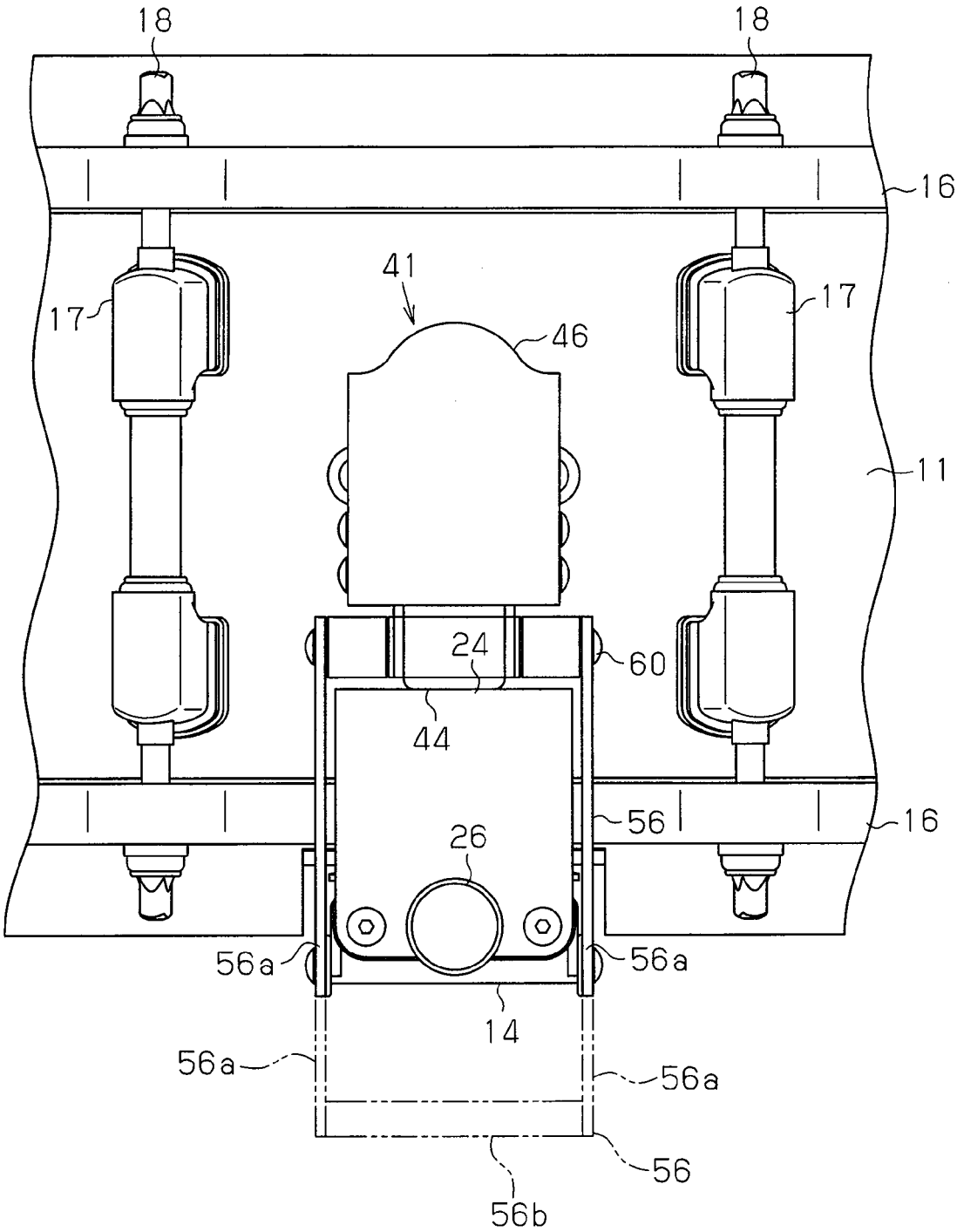
FIG. 4 is an enlarged partial front view showing a second link mechanism of the strainer system.
Figure 5:
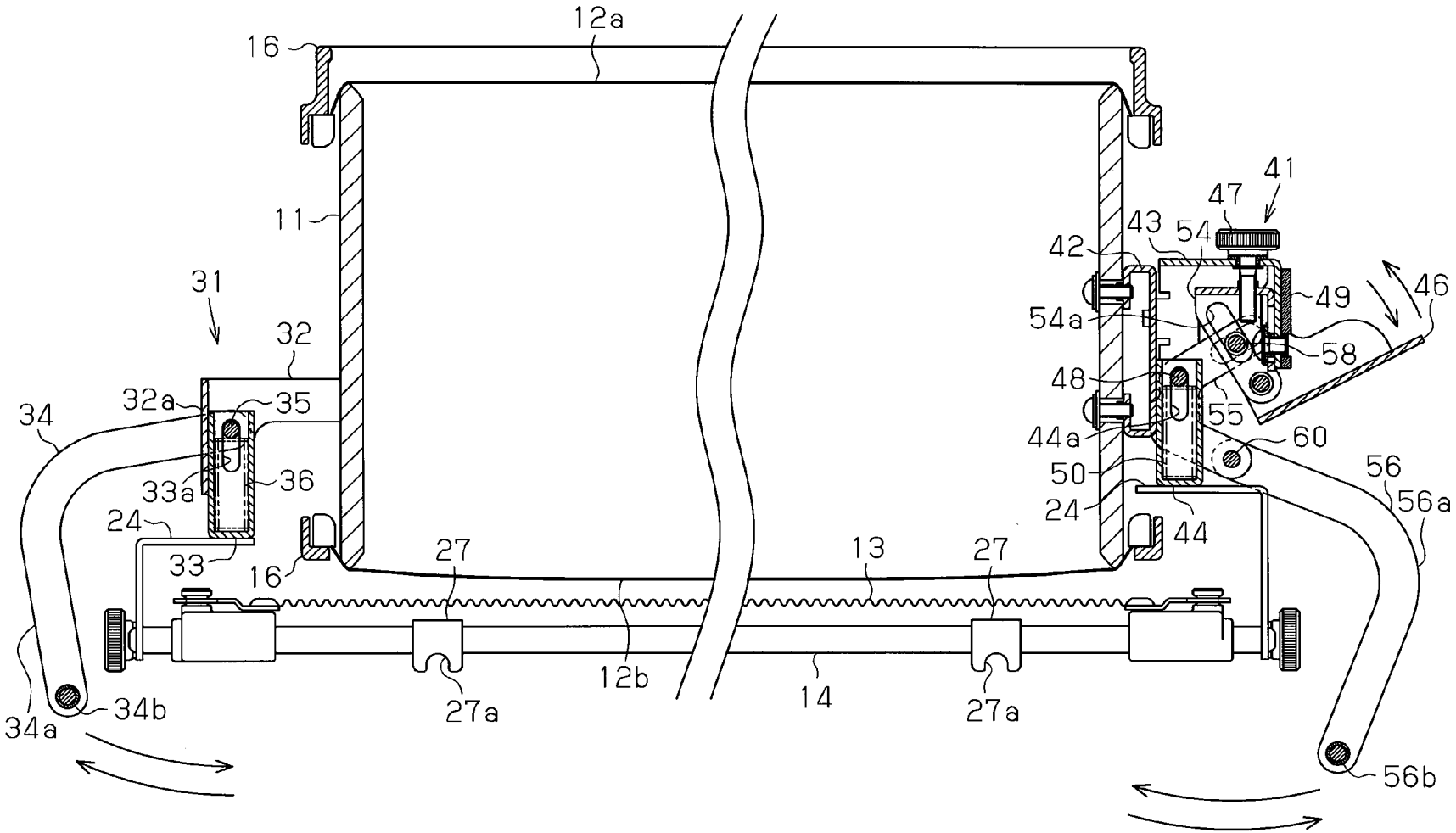
FIG. 5 is a cross-sectional view showing a state that the position of the snare wire is switched to an OFF position.
Figure 6:
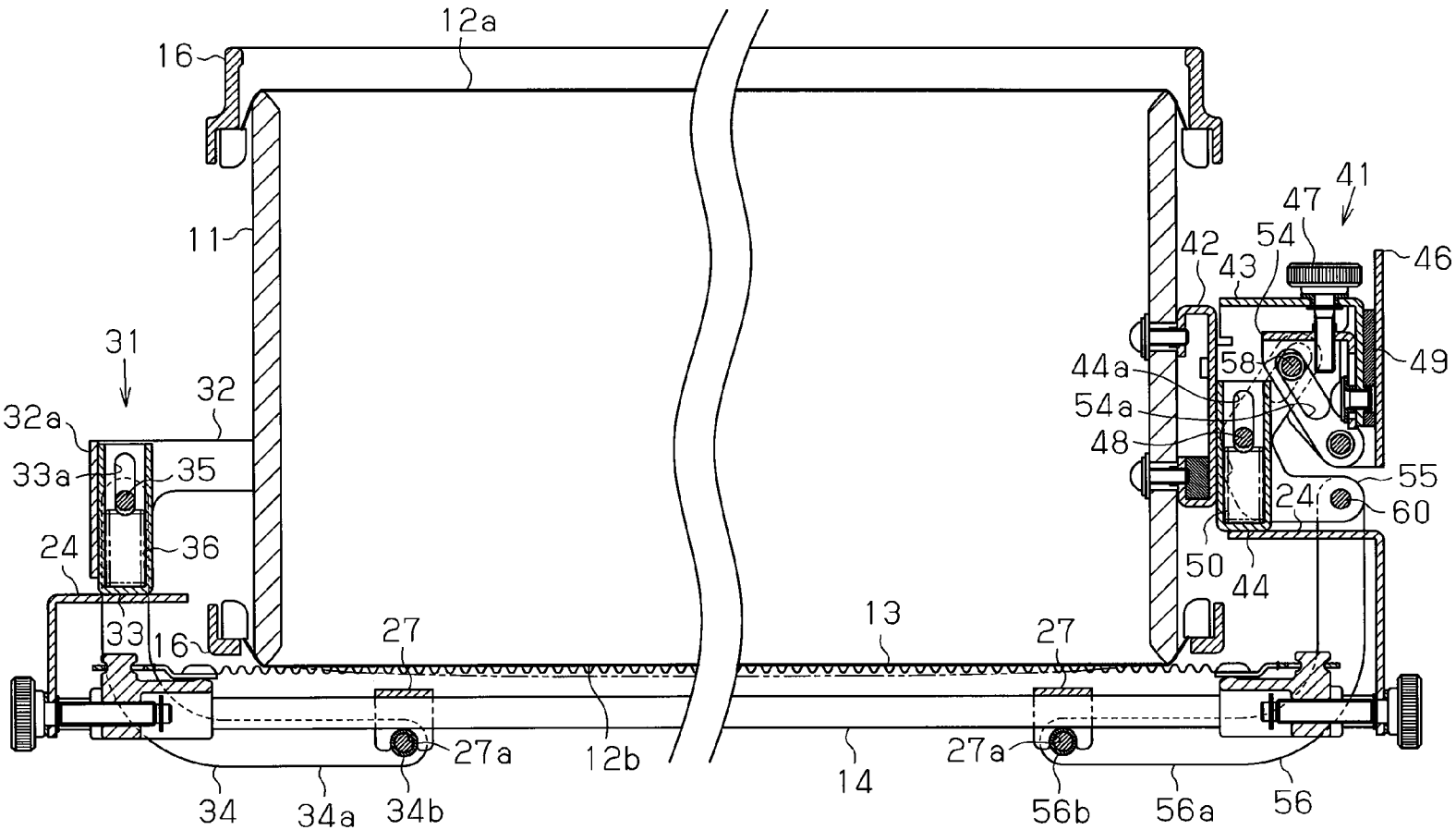
FIG. 6 is a cross-sectional view showing a state that the position of the snare wire is switched to an ON position.
Figure 7:
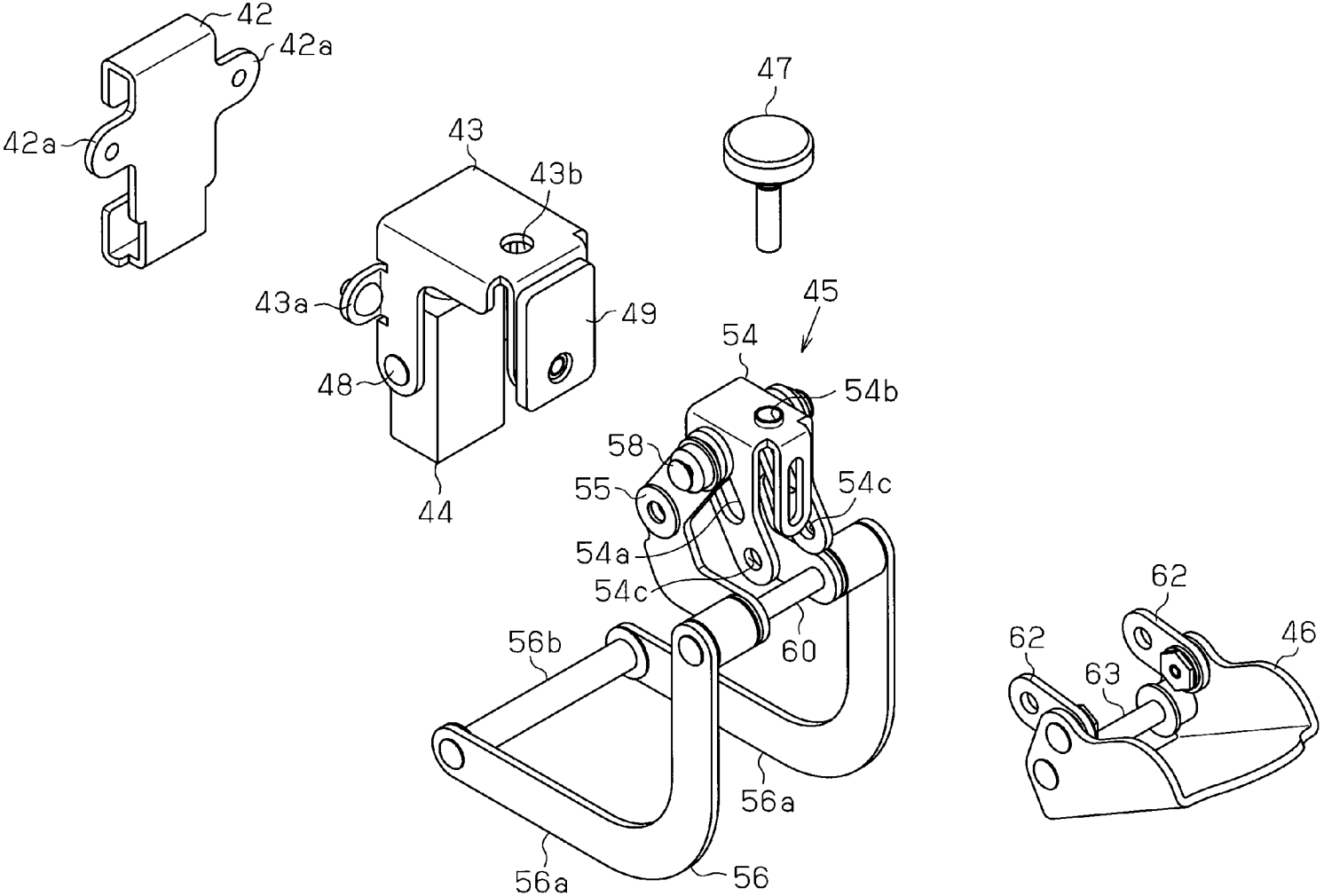
FIG. 7 is an exploded perspective view of the second link mechanism.

As shown in FIGS. 3, 5, and 6, the first link mechanism 31 includes a base 32 to be fixed to the outer peripheral surface of the shell 11, a guide member 33 in a square tubular shape whose lower face is closed, and a first link member 34 to be connected to the first end portion of the frame 14. The base 32 includes a holder 32*a* in a square tubular shape extending in the up and down direction. Inside the holder 32*a*, a guide member 33 is housed. In both side walls of the guide member 33, guide grooves 33*a* extending in the up and down direction are formed, respectively. A support shaft 35 extending in the lateral direction is inserted through the guide grooves 33*a*. With the support shaft 35, the guide member 33 is supported slidably with respect to the holder 32*a* of the base 32. Inside the guide member 33, a coil spring 36 is arranged while being compressed by the support shaft 35 and the lower wall of the guide member 33. By this coil spring 36, the guide member 33 is always urged downward.

Both ends of the support shaft 35 project sideways from both side surfaces of the holder 32*a*. To both ends of the support shaft 35, a first link member 34 is joined pivotably. The first link member 34 includes a pair of substantially L-shaped arms 34*a*, and an engagement bar 34*b* which connects the distal ends of the arms 34*a*. The upper ends of the arms 34*a* are joined to both ends of the support shaft 35 pivotably. The engagement bar 34*b* is engaged in and disengaged from the engagement holes 27*a* of the hook 27 near the first end portion of the frame 14. The first end portion of the frame 14 is urged downward by the guide member 33, and is held so as not to come off the first link mechanism 31 by engaging the engagement bar 34*b* with the hook 27.

As shown in FIGS. 4 to 7, the second link mechanism 41 includes a first base 42, a second base 43, a guide member 44, a link assembly 45, a switch lever 46, and an adjust screw 47. The first base 42 has a substantially C-shaped cross section, and the upper end and the lower end of the first base 42 are bent inward. The upper and lower ends of the first base 42 are fixed to the outer peripheral surface of the shell 11 by bolts inserted from the inside of the shell 11. The first base 42 has a pair of attaching portions 42*a* projecting sideways at the centers of both side edges.

The second base 43 is substantially in a box shape. The second base 43 has a pair of attaching portions 43*a* projecting sideways on the side edges of both side walls. The second base 43 is attached to both attaching portions 42*a* of the first base 42 by a pair of bolts inserted from the front surfaces of the attaching portions 43*a*. In the upper surface of the second base 43, an insertion hole 43*b* through which a threaded portion of the adjust screw 47 is inserted is made. At the distal ends of both side walls of the second base 43, a support shaft 48 extending in the lateral direction is supported. To the side wall facing a switch lever 46 of the second base 43, a rectangular rubber plate 49 is fixed.

The guide member 44 is in a square tubular shape whose lower side is closed. In both side walls of the guide member 44, guide grooves 44*a* extending in the up and down direction are provided, respectively. Through both guide grooves 44*a*, the support shaft 48 is inserted and arranged. With this support shaft 48, the guide member 44 is supported slidably between both side walls of the second base 43. Inside the guide member 44, a coil spring 50 is arranged while compressed by the support shaft 48 and the lower wall of the guide member 44. Similar to the guide member 33 of the first link mechanism 31, the guide member 44 is always urged downward by the coil spring 50. The coil spring 50 of the second link mechanism 41 has the same elastic modulus as that of the coil spring 36 of the first link mechanism 31.

The link assembly 45 includes a slider 54, a pair of cam plates 55, and a second link member 56 which is connected to the second end portion of the frame 14. The slider 54 is substantially in a box shape whose lower side is opened. In the upper surface of the slider 54, a screw hole 54*b* in which the distal end of the adjust screw 47 is screwed is made. In both side walls of the slider 54, slide grooves 54*a* extending diagonally and joint holes 54*c* to be used for joining to the switch lever 46 are made. Through the slide grooves 54*a*, a joint shaft 58 extending in the lateral direction is inserted and arranged. Both ends of the joint shaft 58 project sideways from both side walls of the slider 54.

To both ends of the joint shaft 58, upper ends of cam plates 55 are joined pivotably, respectively. Each cam plate 55 is substantially V-shaped. The center of each cam plate 55 is joined to the support shaft 48 of the second base 43. The lower end of each cam plate 55 is joined to the upper end of the second link member 56 pivotably with a support shaft 60. Specifically, each cam plate 55 is joined pivotably to the slider 54, the second base 43, and the second link member 56 at three positions of the upper end, the center, and the lower end thereof. The second link member 56 includes a pair of arms 56*a* in a substantially L shape, and an engagement bar 56*b* which connects the distal ends of the arms 56*a*. The upper ends of the arms 56*a* are joined to both ends of the support shaft 60 pivotably. The engagement bar 56*b* is engaged in and disengaged from engagement holes 27*a* of the hook 27 near the second end portion of the frame 14. The second end portion of the frame 14 is urged downward by the guide member 44, and is held so as not to come off the second link mechanism 41 by engaging the engagement bar 56*b* with the hook 27.

The switch lever 46 is joined pivotably to the joint shaft 58 of the slider 54 with a pair of link parts 62. The switch lever 46 is joined pivotably to both joint holes 54*c* of the slider 54 with a joint shaft 63. The switch lever 46 is operated when switching the position of the snare wire 13 between the OFF position spaced from the lower drumhead 12*b* and the ON position in contact with the lower drumhead 12*b*. In detail, by pushing down the upper end of the switch lever 46 as shown in FIG. 5, the frame 14 is arranged at the first position, and the snare wire 13 is arranged at the OFF position spaced from the surface of the lower drumhead 12*b*. On the other hand, when the upper end of the switch lever 46 is pushed up as shown in FIG. 6, the frame 14 is arranged at the second position and the snare wire 13 is arranged at the ON position in contact with the surface of the lower drumhead 12*b*. In the present embodiment, the operating section for switching the position of the snare wire 13 to the ON position or the OFF position includes the switch lever 46, the cam plates 55, and the second link member 56.

The operation of the strainer system 15 will be described with reference to FIGS. 2, 5, and 6.

First, as shown in FIG. 2, the snare wire 13 is attached to the frame 14. In detail, each attachment tool 21 of the snare wire 13 is attached to each moving member 25 of the frame 14.

Next, the frame 14 attached with the snare wire 13 is fitted to the shell 11 of the snare drum 10. In detail, as shown in FIG. 5, on the first link mechanism 31, one bracket 24 of the frame 14 is brought into contact with the lower surface of the guide member 33. Then, in this state, the first link member 34 is pivoted counterclockwise in FIG. 5, and the engagement bar 34*b* is engaged with the hook 27 of the frame 14. On the second link mechanism 41, the other bracket 24 of the frame 14 is brought into contact with the lower surface of the guide member 44. Then, in this state, the second link member 56 is pivoted clockwise in FIG. 5, and the engagement bar 56*b* is engaged with the other hook 27 of the frame 14. By these operations, the end portions of the frame 14 are attached to the shell 11 of the snare drum 10 with the first and second link mechanisms 31 and 41. In this state, the frame 14 is arranged at the first position, and the snare wire 13 is arranged at the OFF position spaced from the surface of the lower drumhead 12*b*.

Next, the upper end of the switch lever 46 is pushed up as shown in FIG. 6 to switch the position of the snare wire 13 on the frame 14 to the ON position in contact with the surface of the lower drumhead 12*b*. In detail, the switch lever 46 is pivoted to a position at which the back surface thereof comes into contact with the rubber plate 49 of the second base 43. According to the pivoting movement of the switch lever 46, the joint shaft 58 joined to the switch lever 46 with the link part 62 moves upward inside the slide grooves 54*a*. According to the rise of the joint shaft 58, the cam plates 55 joined to the joint shaft 58 pivot counterclockwise around the support shaft 48. According to the pivoting movement of the cam plates 55, the second link member 56 joined to the lower ends of the cam plate 55 moves upward, and accordingly, the second end portion of the frame 14 held by the second link member 56 is lifted. At this time, according to the lifting of the frame 14 by the second link member 56, the first end portion of the frame 14 held by the first link member 34 is also lifted. Thus, the frame 14 is switched from the first position to the second position, and the snare wire 13 is switched from the OFF position to the ON position.

When moving the frame 14 from the first position to the second position, the first end portion of the frame 14 is urged downward by the coil spring 36 in the first link mechanism 31, and the second end portion of the frame 14 is urged downward by the coil spring 50 in the second link mechanism 41. The ends of the frame 14 are thus urged by the coil springs 36 and 50, so that when the frame 14 is lifted by the link mechanisms 31 and 41, the frame 14 is made parallel to the surface of the lower drumhead 12*b*, and the snare wire 13 is also made parallel to the surface of the lower drumhead 12*b*.

After the snare wire 13 is arranged at the ON position, to adjust the contact pressure of the snare wire 13 with respect to the lower drumhead 12*b*, the frame 14 held by the second link member 56 is lifted or lowered by turning the adjust screw 47 of the second link mechanism 41. In detail, by changing the screwing amount into the slider 54 by turning the adjust screw 47, the slider 54 rises or lowers with respect to the second base 43. Accordingly, both cam plates 55 joined to the slider 54 and second link member 56 joined to both cam plates 55 rise or lower together, and the frame 14 held by the second link member 56 rises or lowers. According to this rising or lowering of the frame 14 with respect to the second position as a reference, the contact pressure of the snare wire 13 with the lower drumhead 12*b* is adjusted. In addition to the adjustment of the contact pressure of the snare wire 13, by operating the adjust screws 26 on both ends of the frame 14, the distance between both moving members 25 is changed to adjust the tension of the snare wire 13 or the positions of both moving members 25 are changed to adjust the position in the lateral direction of the snare wire 13. In the present embodiment, the adjusting mechanism for adjusting the contact pressure of the snare wire 13 with the lower drumhead 12*b* includes the first and second bases 42 and 43, the adjust screw 47, the slider 54, the cam plate 55, and the second link member 56.

The present embodiment brings about the following advantages.

(1) When playing the snare drum 10, to improve the sound response and tone of the snare wire 13, it is preferable that the snare wire 13 be brought into uniform contact with the surface of the lower drumhead 12*b*. In this regard, according to the present embodiment, by making one of the pair of link mechanisms 31 and 41 function as a strainer, the snare wire 13 can be brought into uniform contact with the surface of the lower drumhead 12*b* regardless of dimensional errors of the outer diameter of the shell 11 and the length of the frame 14. Therefore, the operability of changing the position of the snare wire 13 with respect to the lower drumhead 12*b* is improved.

(2) The second link mechanism 41 which functions as a strainer includes an adjusting mechanism which adjusts the position of the snare wire 13 arranged at the ON position with respect to the lower drumhead 12*b*. According to this constitution, the operation for switching the position of the snare wire 13 to the ON position or the OFF position, and the operation for adjusting the contact pressure of the snare wire 13 with the lower drumhead 12*b* after switching the position of the snare wire 13 to the ON position can be performed at one position on only the second link mechanism 41. Therefore, the operability of changing the position of the snare wire 13 with respect to the lower drumhead 12*b* is further improved.

(3) The second link mechanism 41 includes a second link member 56 to be fitted to the second end portion of the frame 14. By moving up and down this second link member 56, ON-OFF switching of the snare wire 13 and adjustment of the contact pressure of the snare wire 13 with respect to the lower drumhead 12*b* can be performed. Thus, by using one component constituting the second link mechanism 41, the ON-OFF operations of the snare wire 13 and the adjustment of the contact pressure of the snare wire 13 can be performed. Thereby, one component is commonly used. Accordingly, the constitution of the entire strainer system is simplified.

(4) The strainer includes a switch lever 46 and cam plates 55 joined to the second link member 56. The pivoting movement according to the operation of the switch lever 46 is converted into up and down movement through the cam plates 55, and the second link member 56 moves between the first position and the second position. In this case, by using the cam plates 55, the constitution for moving up and down the second link member 56 between the first position and the second position is simplified.

(5) The adjusting mechanism includes the first and second bases 42 and 43, and the slider 54 which is supported on the second base 43 with the adjust screw 47 and is joined to the cam plates 55. In this case, by using the screw mechanism constituted by the adjust screw 47 and the slider 54, the constitution for moving up and down the second link member 56 with respect to the second position as a reference is simplified. By adjusting the position of the snare wire 13 by turning the adjust screw 47, the contact pressure of the snare wire 13 with respect to the lower drumhead 12*b* can be easily adjusted with small variation widths.

(6) Both ends of the frame 14 are elastically held with respect to the shell 11 by the link mechanisms 31 and 41, so that the frame 14 can be raised or lowered in parallel to the surface of the lower drumhead 12*b*. Accordingly, the snare wire 13 can be brought into parallel contact with the lower drumhead 12*b*, and the contact pressure of the snare wire 13 with respect to the lower drumhead 12*b* can be made uniform. Therefore, the sound response and tone of the snare wire 13 are improved. When switching the position of the snare wire 13 from the OFF position to the ON position, the snare wire 13 is prevented from rubbing against the lower drumhead 12*b*. Therefore, noise due to the contact between the lower drumhead 12*b* and the snare wire 13 is prevented as much as possible.

(7) In the first link mechanism 31, the first end portion of the frame 14 is urged downward by the coil spring 36, and in the second link mechanism 41, the second end portion of the frame 14 is urged downward by the coil spring 50. With this constitution, both ends of the frame 14 are elastically and stably held with respect to the shell 11 by the urging forces of the coil springs 36 and 50, so that it becomes easy to bring the snare wire 13 into parallel contact with the lower drumhead 12*b*. The coil springs 36 and 50 are inexpensive and easy to come by, so that the manufacturing costs are not increased.

(8) In the first link mechanism 31, the engagement bar 34*b* of the first link member 34 is engaged with and disengaged from the hook 27 near the first end portion of the frame 14, and in the second link mechanism 41, the engagement bar 56*b* of the second link member 56 is engaged with and disengaged from the hook 27 near the second end portion. With this constitution, for replacement and tuning of the lower drumhead 12*b*, the workability of attaching and detaching the snare wire 13 to and from the shell 11 is improved.

(9) On the upper surface of each moving member 25 of the frame 14, the protrusion 25*b* which is engaged in the hole 21*a* of each attachment tool 21 of the snare wire 13 is provided. With this constitution, the snare wire 13 can be attached to the frame 14 only by engaging the pair of protrusions 25*b* of the frame 14 in the holes 21*a* at both ends of the snare wire 13. Both ends of the snare wire 13 are point-supported by the pair of protrusions 25*b* of the frame 14, so that the snare wire 13 comes into contact with the surface of the lower drumhead 12*b* along this surface. Accordingly, the snare wire 13 is reliably brought into contact with the lower drumhead 12*b*.

(10) The frame 14 includes a pair of rods 23, a pair of moving members 25 fitted slidably to the rods 23, and adjust screws 26 for adjusting the positions of the moving members 25 with respect to the rods 23. With this constitution, by changing the positions of the moving members 25 with respect to the rods 23 by the adjust screws 26, the distance between the moving members 25 can be adjusted, and the tension of the snare wire 13 attached to the moving members 25 can be adjusted. In other words, the contact pressure of the snare wire 13 with respect to the lower drumhead 12*b* and the tension of the snare wire 13 can be adjusted separately. By changing the positions of the moving members 25 with respect to the rods 23, the position in the lateral direction of the snare wire 13 with respect to the lower drumhead 12*b* can be adjusted according to the diameter of the shell 11 and the size of the snare wire 13.

The above-described embodiment may be modified as follows.

Figure 8:
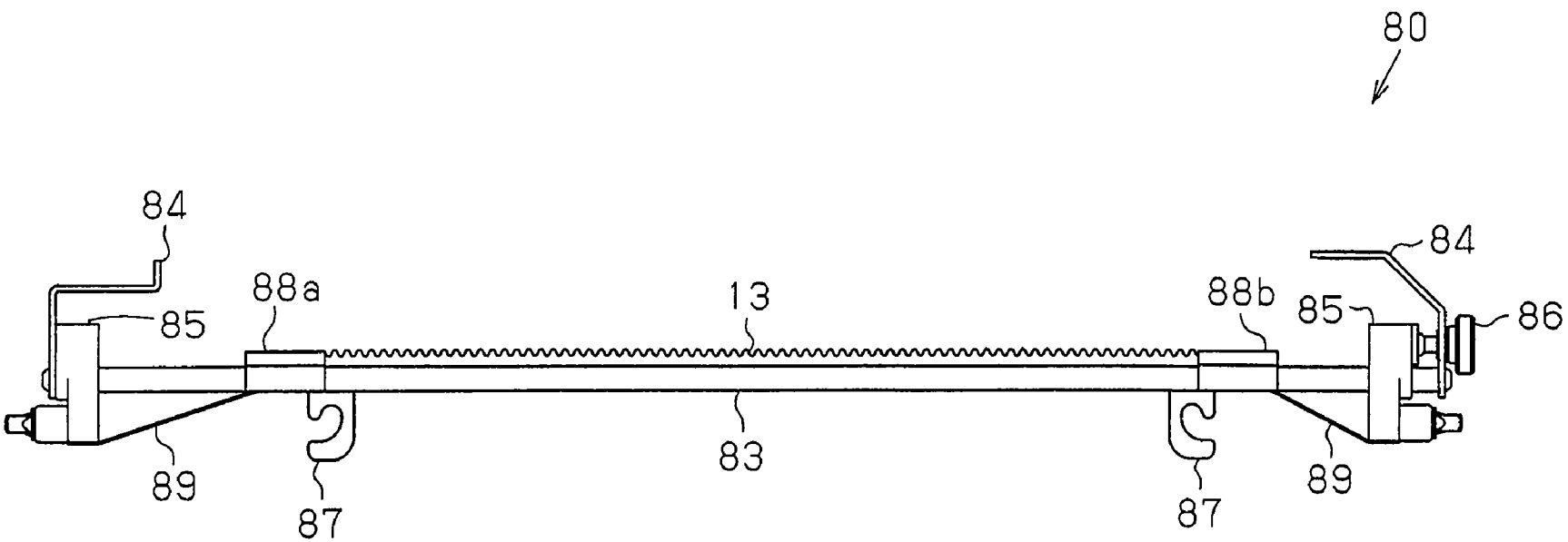
FIG. 8 is a side view of a frame of a modified embodiment.

In the present embodiment, instead of the frame 14, the frame 80 shown in FIG. 8 may be used. The frame 80 includes a pair of rods 83, a pair of brackets 84 fixed to the ends of the rods 83, one head 85 fitted slidably to the rods 83, an adjust screw 86 which adjusts the position of the head 85 with respect to the rods 83, a pair of hooks 87 fixed to the rods 83, and a pair of support plates 88*a* and 88*b* on which the end portions of the snare wire 13 are supported. The first support plate 88*a* is fixed to the head 85 with a belt 89, and the second support plate 88*b* is fixed to the head 85 with a belt 89. By changing the screwing amount into the head 85 by turning the adjust screw 86, the head 85 moves along the axis lines of the rods 83. Thus, by changing the position of the head 85 with respect to the rods 83 by the adjust screw 86, the distance between the support plates 88*a* and 88*b* is adjusted, and the tension of the snare wire 13 attached to the support plates 88*a* and 88*b* is adjusted.

In the illustrated embodiments, the coil springs 36 and 50 may be omitted from the link mechanisms 31 and 41. In this case, by raising the second end portion of the frame 14 while the snare wire 13 on the first end portion of the frame 14 is brought into contact with the lower drumhead 12*b*, the entirety of the snare wire 13 can be brought into contact with the lower drumhead 12*b*.

In the illustrated embodiments, instead of the coil springs 36 and 50, elastic members such as a leaf spring, rubber, and urethane, for example, may be used.

In the illustrated embodiments, the link members 34 and 56 may be fixed to corresponding end portions of the frame 14 by using bolts or the like.

In the illustrated embodiments, the pair of protrusions 25*b* of the frame 14 are engaged in holes 21*a* at both ends of the snare wire 13. However, the snare wire 13 may be fixed to the frame 14 by using bolts or the like. Alternatively, the snare wire 13 may be formed integrally with the frame 14.

In the illustrated embodiments, the tension of the snare wire 13 attached onto the frame 14 is changeable. However, this function may be omitted from the frame 14.

In the illustrated embodiments, from either one of the first and second end portions of the frame 14, the tension changing means for changing the tension of the snare wire 13 and the position changing means for changing the position in the lateral direction of the snare wire 13 may be omitted.

In the illustrated embodiments, the distal ends of the link members 34 and 56 may be elongated, and the hooks 27*a* may be respectively provided at positions corresponding to the engagement bars 34*a* and 56*a* of the elongated link members 34 and 56. This allows the frame 14 to be supported at positions closer to the center than the end portions.

In the illustrated embodiments, an adjusting mechanism for adjusting the contact pressure of the snare wire 13 with the lower drumhead 12*b* may be provided in the first link mechanism 31 which holds the first end portion of the frame 14.

In the illustrated embodiments, the first and second link mechanisms 31 and 41 may be attachable to and detachable from corresponding two positions on the outer peripheral surfaces of the shell 11. Accordingly, when the snare drum 10 is placed on the floor or a desk, etc., the lower drumhead 12*b* is prevented from being damaged or broken by the link members 34 and 56 arranged below the lower drumhead 12*b*.

In the illustrated embodiments, instead of the cam mechanism, the second link mechanism 41 may have an arbitrary mechanism as a constitution which moves the second link member upward and downward.

The invention claimed is:

1. A strainer system of a snare drum, the snare drum including upper and lower drumheads, the upper drumhead being beaten in playing the snare drum, the strainer system switching the position of a snare wire between an OFF position spaced from the surface of the lower drumhead and an ON position in contact with the surface of the lower drumhead, the strainer system comprising:

a frame to which the snare wire is attached, wherein the frame extends along the surface of the lower drumhead and has a pair of end portions, and wherein the frame includes a pair of rods arranged in parallel and a pair of hooks fixed to the rods;

a pair of link mechanisms, each one of the pair of link mechanisms being joined to a respective one of the end portions of the frame, and attaching the respective one of the end portions of the frame to a shell of the snare drum; and an operating section that is operated for switching the position of the snare wire between the OFF position and the ON position, wherein the operating section is provided in either one of the pair of link mechanisms, wherein one of the link mechanisms includes a first link member fitted to a first end portion of the frame, and the other of the link mechanisms includes a second link member fitted to a second end portion of the frame, wherein each of the link members include a pair of L-shaped arms and a cross link between the arms, and wherein the pairs of arms pivot about respective positions above the lower drumhead and extend downward relative to the upper drumhead, the pairs of arms being configured to pivot toward the center of the snare drum and to extend below the lower drumhead so that the cross links engage the hooks, the pairs of arms disengaging the cross links from the hooks by pivoting outward relative to the center of the snare drum.

2. The strainer system of a snare drum according to claim 1, further comprising:

an adjusting mechanism which adjusts the position of the snare wire arranged at the ON position with respect to the lower drumhead.

3. The strainer system of a snare drum according to claim 2, wherein the operating section and the adjusting mechanism share the second link member fitted to the second end portion of the frame, and wherein, in accordance with an operation of the operating section, the second link member moves between a first position corresponding to the OFF position and a second position corresponding to the ON position, and wherein, in accordance with an operation of the adjusting mechanism, the second link member moves up and down with respect to the second position as a reference.

4. The strainer system of a snare drum according to claim 3, wherein the operating section includes an operating switch and a cam joined to the second link member, and movement according to an operation of the operating switch is converted into up and down movement through the cam, whereby the second link member moves between the first position and the second position.

5. The strainer system of a snare drum according to claim 4, wherein the adjusting mechanism includes a base which is fixed to the shell and a slider which is supported on the base with an adjustment screw and joined to the cam, and wherein, by changing a position of the adjustment screw in the slider, the slider and the cam move up and down with respect to the base, and accordingly, the second link member moves up and down with respect to the second position as a reference.

6. The strainer system of a snare drum according to claim 1, wherein the respective end portions of the frame are elastically held with respect to the shell while being joined to the respective link mechanisms.

7. The strainer system of a snare drum according to claim 6, further comprising:

a pair of urging means, each one of the pair of urging means urging a respective one of the end portions of the frame in a direction of spacing the end portions from the surface of the lower drumhead.

8. The strainer system of a snare drum according to claim 1, wherein the link mechanisms can be engaged with and disengaged from corresponding end portions of the frame.

9. The strainer system of a snare drum according to claim 1, wherein the snare wire includes a plurality of strands and a pair of attachment tools which join the end portions of the strands to each other, and wherein the frame has a pair of protrusions which are engaged in holes made in the respective attachment tools.

10. The strainer system of a snare drum according to claim 1, wherein the frame has a tension changing means capable of changing the tension of the snare wire attached to the frame.

11. The strainer system of a snare drum according to claim 10, wherein the tension changing means includes a pair of rods extending along the surface of the lower drumhead, and a pair of moving members which are supported slidably on the rods, wherein each of the respective end portions of the snare wire is attached to a respective one of the moving members, and the positions of the moving members are adjustable with respect to the rods.

12. A snare drum comprising: a cylindrical shell; upper and lower drumheads which close upper and lower open ends of the shell, respectively, the upper drumhead being beaten in playing the snare drum; and a strainer system which switches the position of a snare wire between an OFF position spaced from the surface of the lower drumhead and an ON position in contact with the surface of the lower drumhead, wherein the strainer system includes:

a frame to which the snare wire is attached, wherein the frame extends along the surface of the lower drumhead and has a pair of end portions, and wherein the frame includes a pair of rods arranged in parallel and a pair of hooks fixed to the rods;

a pair of link mechanisms, each one of the pair of link mechanisms being joined to a respective one of the end portions of the frame, and attaching the respective one of the end portions of the frame to the shell of the snare drum; and an operating section that is operated for switching the position of the snare wire between the OFF position and the ON position, wherein the operating section is provided in either one of the pair of link mechanisms, wherein one of the link mechanisms includes a first link member fitted to a first end portion of the frame, and the other of the link mechanisms includes a second link member fitted to a second end portion of the frame, wherein each of the link members include a pair of L-shaped arms and a cross link between the arms, and wherein the pairs of arms pivot about respective positions above the lower drumhead and extend downward relative to the upper drumhead, the pairs of arms being configured to pivot toward the center of the snare drum and to extend below the lower drumhead so that the cross links engage the hooks, the pairs of arms disengaging the cross links from the hooks by pivoting outward relative to the center of the snare drum.

13. The strainer system of a snare drum according to claim 1, wherein upon an operation of the operating section to switch the position of the snare wire to the ON position, the first end portion of the frame fitted to the first link member is lifted and the second end portion of the frame fitted to the second link member is lifted.

* * * * *